US005423252A

United States Patent [19]

Yamamoto et al.

[11] Patent Number: 5,423,252

[45] Date of Patent: Jun. 13, 1995

[54] PRINTER FOR SOLID ARTICLES

[75] Inventors: Taizo Yamamoto, Osaka; Hirokazu Konishi, Sakurai, both of Japan

[73] Assignee: Japan Elanco Company, Ltd., Osaka, Japan

[21] Appl. No.: 147,563

[22] Filed: Nov. 5, 1993

[30] Foreign Application Priority Data

Nov. 6, 1992 [JP] Japan ..... 4-322505

[51] Int. Cl.[6] ..... B41F 17/30

[52] U.S. Cl. ..... 101/35; 101/4; 101/37; 101/39; 101/40; 206/534

[58] Field of Search ..... 101/35, 40, 36, 37, 101/39, 40.1, 4, 424.1; 221/171, 173; 206/534; 382/10, 13, 34

[56] References Cited

U.S. PATENT DOCUMENTS

| | | | |
|---|---|---|---|
| 3,884,143 | 5/1975 | Ackley | 101/35 |
| 3,889,591 | 6/1975 | Noguchi | 101/37 |
| 4,235,579 | 11/1980 | Kurz et al. | 101/424.1 |
| 4,528,904 | 7/1985 | Ackley | 101/35 |
| 4,619,196 | 10/1986 | Matsuoka | 101/35 |
| 4,648,053 | 3/1987 | Fridge | 382/10 |
| 4,672,892 | 6/1987 | Ackley | 101/35 |
| 4,830,194 | 5/1989 | Kajiura et al. | 209/580 |
| 4,905,589 | 3/1990 | Ackley | 101/35 |
| 5,058,175 | 10/1991 | Aso | 382/1 |
| 5,237,621 | 8/1993 | Cox et al. | 382/8 |
| 5,305,392 | 4/1994 | Longest, Jr. et al. | 382/8 |

FOREIGN PATENT DOCUMENTS

| | | |
|---|---|---|
| 53-32759 | 9/1978 | Japan . |
| 61-10457 | 1/1986 | Japan . |

*Primary Examiner*—Edgar S. Burr
*Assistant Examiner*—Lynn D. Hendrickson
*Attorney, Agent, or Firm*—Fish & Richardson

[57] ABSTRACT

A printer for printing predetermined patterns of letters, figures, marks and the like on surfaces of solid articles such as tablets or capsule articles which includes a horizontal carrier for carrying the regularly arranged solid articles in a horizontal direction, an ink pattern transfer device for transferring the patterns on the surfaces of the solid articles, a print quality judging device for judging the quality of the printed ink patterns and an inferior article remover for automatically removing articles of inferior print quality from the manufacturing process.

19 Claims, 4 Drawing Sheets

PRINTER FOR SOLID ARTICLES

FIELD OF THE INVENTION

This invention relates to a printer for printing predetermined patterns of letters, figures, marks and the like on the surfaces of solid articles such as tablets or capsules.

BACKGROUND OF THE INVENTION

A conventional printer for solid articles is shown, for example, in Publication Gazette of Examined Japanese Patent Application Sho 53-32759 or Publication Gazette of Unexamined Japanese Patent Application Sho 61-10457. FIG. 4 is a sectional side view showing a configuration of the conventional printer for solid articles.

In the conventional printer for solid articles shown in FIG. 4, solid articles 200 are fed from a hopper 100 to a feeding drum 101. The feeding drum 101 has a plurality of compartments which are regularly arranged in the rotation direction and axial direction of the drum. The solid articles 200 are held and carried in the pockets of the feeding drum 101. A transfer roller 102 which is made of rubber is provided to contact the surfaces of the solid articles 200 in the pockets of the feeding drum 101. Ink patterns which are turned inside out (i.e. mirror images) of patterns to be printed on the surfaces of the solid articles 200 are transferred to the surface of the transfer roller 102 from a design roller 105. When the transfer roller 102 is pushed into the solid articles 200 on the feeding drum 101, the ink patterns are transferred to the surfaces of the solid articles 200. When the transferred ink patterns are dried, the printing of the solid articles is completed. The printed solid articles 200 are dropped in a collector 103. Thus, the printed solid articles 200 are collected.

In the above-mentioned conventional printer for solid articles, arrangement of tile solid articles 200, transcription of the ink patterns and collection of the printed solid articles are executed while the feeding drum 101 rotates about a $\frac{3}{4}$ turn. Therefore, the solid articles 200 are collected in the collector 103 without completely drying the transferred ink patterns. According to the treatment of the solid articles 200, the transferred ink patterns will be spread or tile transferred ink will run. Thus, tile solid article 200 of the spread ink pattern will be judged as an inferior article. Furthermore, after the collection of the solid articles 200 in the collector 103, the solid articles 200, which have been arranged on the feeding drum 101, lose their regular arrangements, so that it is impossible to print the patterns on both sides of the solid articles 200. Further, the printed solid articles 200 are collected in the collector 103 at random, so that it is necessary to provide another judging process independently For evaluating the quality of the printed patterns. Moreover, the judgement of the quality of the printed patterns is performed visionally, which is inefficient.

SUMMARY OF THE INVENTION

A purpose of this invention is to solve the abovementioned problems, that is, to provide an improved printer For solid articles which can completely dry the ink patterns transferred to the solid articles before the collection of the solid articles, and automatically judge the quality of the printed patterns and remove the articles of inferior print quality.

An embodiment of a printer for solid articles in accordance with the invention comprises:

a horizontal carrier having regularly arranged pockets for holding and horizontally carrying solid articles therein;

a solid article feeder for feeding the solid articles to the horizontal carrier and arranging the solid articles regularly;

an ink pattern transfer device, which is provided above a part of the horizontal carrier, to transfer previously designed ink patterns to the surfaces of the solid articles which are carried by the horizontal carrier;

a print quality judging device, which is provided above another part of the horizontal carrier, to judge the quality of the transferred ink patterns on the surfaces of the solid articles; and an inferior article remover for removing the inferior articles which are judged as inferior quality by the quality judging device.

the above-mentioned configuration, it is desirable that the printer further comprises a dryer provided at the rear of the ink pattern transfer device and above the horizontal carrier for drying the transferred ink patterns on the surfaces of the solid articles.

Furthermore, it is desirable that the inferior article remover has an air gun for blowing off an article of inferior print quality into an inferior article collector.

Furthermore, it is desirable that the printer comprises an air absorption device for firmly holding the solid articles in the pockets of the horizontal carrier by vacuum pressure so that the solid articles in the pockets do not move during printing by the ink pattern transfer device and/or do not drop out from the pockets due to gravity.

Furthermore, it is desirable that the horizontal carrier is an endless conveyor having rotating parts positioned at both horizontal ends thereof and rotating in the vertical plane, and using a horizontally moving part as the horizontal carrier.

Another embodiment of a printer for solid articles in accordance with this invention comprises:

horizontal carrier having regularly arranged pockets for holding and horizontally carrying solid articles therein;

a solid article feeder for feeding the solid articles to the horizontal carrier and arranging the solid articles regularly;

an ink pattern transfer device, which is provided above a part of the horizontal carrier, to transfer previously designed ink patterns to the surfaces of the solid articles which are carried by the horizontal carrier;

a print quality judging device, which is provided above another part of the horizontal carrier, to judge the quality of the transferred ink patterns on the surfaces of the solid articles;

an inferior article remover for removing the inferior articles which are judged as inferior quality by the quality judging device; and a reverse horizontal carrier provided in the reverse side of the horizontal carrier for horizontally carrying the printed solid articles upside down in a reverse direction.

In tile above-mentioned configuration, it is desirable that the printer further comprises a dryer provided at the rear of tile ink pattern transfer device and above the horizontal carrier or below tile reverse horizontal carrier For drying the transferred ink patterns on the surfaces of the solid articles.

Furthermore, it is desirable that the inferior article remover has an air gun for blowing off an article of inferior print quality to an inferior article collector.

Furthermore, it is desirable that the printer further comprises an air absorption device for firmly holding the solid articles in the pockets of the horizontal carrier by vacuum pressure, so that tile solid articles in the pockets do not move during printing by the ink pattern transfer device and/or do not drop out from the pockets due to gravity.

Furthermore, it is desirable that the horizontal carrier is an endless conveyor having rotating parts positioned at both horizontal ends thereof and rotating in the vertical plane, and using an upper horizontally moving part as the horizontal carrier and a lower horizontally moving part as the reverse horizontal carrier.

Still another embodiment of a printer for solid articles in accordance with this invention comprises:

- a first horizontal carrier having regularly arranged pockets for holding and horizontally carrying solid articles therein;
- a solid article feeder for feeding the solid articles to the first horizontal carrier and arranging the solid articles regularly;
- a first ink pattern transfer device, which is provided above a part of the first horizontal carrier, to transfer previously designed first ink patterns on the surfaces of the solid articles which are carried by the first horizontal carrier;
- a first print quality judging device, which is provided above another part of tile first horizontal carrier, to judge the quality of the transferred first ink patterns on the surfaces of the solid articles;
- a first inferior article remover for removing inferior articles which are judged as inferior quality by the first quality judging device;
- a second horizontal carrier having regularly arranged pockets for holding and horizontally carrying upside down the solid articles passing through the first inferior article remover;
- a second ink pattern transfer device, which is provided above a part of the second horizontal carrier, to transfer previously designed second ink patterns on the surfaces of the solid articles which are not printed yet;
- a second print quality judging device which is provided above another part of the second horizontal carrier to judge the quality of the transferred second ink patterns transferred to the solid articles; and
- a second inferior article remover for removing inferior articles which are judged as inferior quality by the second quality judging device.

In the above-mentioned configuration, it is desirable that the printer further comprises a first dryer provided between the first ink pattern transfer device and the second ink pattern transfer device for drying the transferred first ink patterns on the surfaces of tile solid articles.

Furthermore, It is desirable that the printer further comprises a second dryer provided at the rear of the second ink pattern transfer device for forcibly drying the transferred second ink pattern on the other surfaces of the solid articles.

Furthermore, it is desirable that the first and second inferior article remover has an air gun for blowing off an article of inferior print quality to an inferior article collector.

Furthermore, it is desirable that the printer further comprises air absorption devices for firmly holding the solid articles in the pockets of the first and second horizontal carriers by vacuum pressure so that the solid articles in the pockets do not move during printing by the ink pattern transfer device and/or do not drop out from the pockets due to gravity.

Furthermore, it is desirable that the first and second horizontal carriers are endless conveyors respectively having rotating parts positioned at both horizontal ends thereof and rotating in the vertical plane, and using horizontally moving parts as the first and second horizontal carriers.

Furthermore, it is desirable that the printer further comprises a solid articles reversing device provided between the first horizontal carrier and the second horizontal carrier for turning the solid articles upside down.

Furthermore, it is desirable that the solid articles reversing device is a reverse horizontal carrier provided in the reverse side of the horizontal carrier for horizontally carrying the printed solid articles upside down in a reverse direction.

The printer for solid articles described above has a length which is sufficient for drying the ink transferred to the solid articles. The distance is utilized for automatically judging the quality of the transferred patterns and removing the inferior articles if inferior articles are present in the printed solid articles.

The horizontal carrier is, for example, a chain conveyor, belt conveyor, and the like (which is referred hereinafter as "conveyor"), and has a plurality of pockets on its surface regularly arranged in the moving direction and in the width direction of the conveyor. The solid articles are contained in and carried by the pockets.

The solid article feeder is a rotation drum having a plurality of pockets regularly arranged in the rotation direction and the axial direction on its drum surface, hopper and so on. By applying vibrations or air flow to the solid articles which are fed from the hopper at random, the solid articles are regularly arranged in the pockets of the rotation drum. After that, the solid articles are transferred from the pockets of the rotation drum to the pockets of the conveyor.

The ink pattern transfer device comprises an ink pan for storing the ink, a design roller having concave patterns corresponding to the patterns to be printed on its drum surface, a cleaner for removing the superfluous ink from the surface of the design roller, a transfer roller to which the ink remaining in the concave patterns of the design roller is transferred, and so on. The ink pattern transfer device is provided above a part of the conveyor. When the ink patterns, which are the reverse patterns of the patterns to be printed are pressed to the surfaces of the solid articles, the surfaces of tile solid articles are printed.

The quality judging device comprises an image pick up device and a judging device such as a microcomputer and the like for comparing an image picked up by the image pick up device and predetermined patterns (which show the minimum allowable quality of the articles). These devices are provided above a part of the conveyor where the solid articles are carried. When the judging device finds a solid article of inferior print quality, it outputs a removing signal after passing a predetermined time period which is necessary to reach the solid article of inferior print quality to the inferior article remover.

The inferior article remover is, for example, an air gun or the like, and it blasts air of a predetermined pressure when it receives the removing signal. Thereby, the solid article of inferior print quality is blown off to an inferior article collection basket, or the like. Then, the article of inferior print quality is removed from the manufacturing process.

For down sizing the printer for solid articles, the reverse horizontal carrier is provided on the reverse side of the horizontal carrier. For example, a top side of an endless conveyor is used as the horizontal carrier and a bottom side thereof is used as the reverse horizontal carrier. A small hole is provided in each pocket of the conveyor, and the air in the pocket is absorbed through the small hole by a vacuum pump or the like. Thereby, when the solid articles are carried by the reverse horizontal carrier, the solid articles are held in the pockets of the conveyor by vacuum pressure. As a result, the solid articles do not drop due to gravity.

Since the dryer such as an electric heater, a hot-air dryer and so on is provided, tile ink pattern transferred to the surface of the solid article is forcibly dried.

Furthermore, when two sets of the ink pattern transfer device, print quality judging device and inferior article removing device are respectively provided above the first horizontal carrier and the second horizontal carrier and the faces of the solid articles are turned upside down in respective first and second horizontal carriers, the solid articles can be printed on both sides.

Since the dryer is provided between the first ink pattern transfer device and the second ink pattern transfer device, the ink transferred to one side face of the solid article is forcibly. dried until the solid article reaches the second ink pattern transfer device. Therefore, when the other side face of the solid article is printed, the printed ink pattern may not spread.

DETAILED DESCRIPTION OF THE INVENTION

Figure 1:
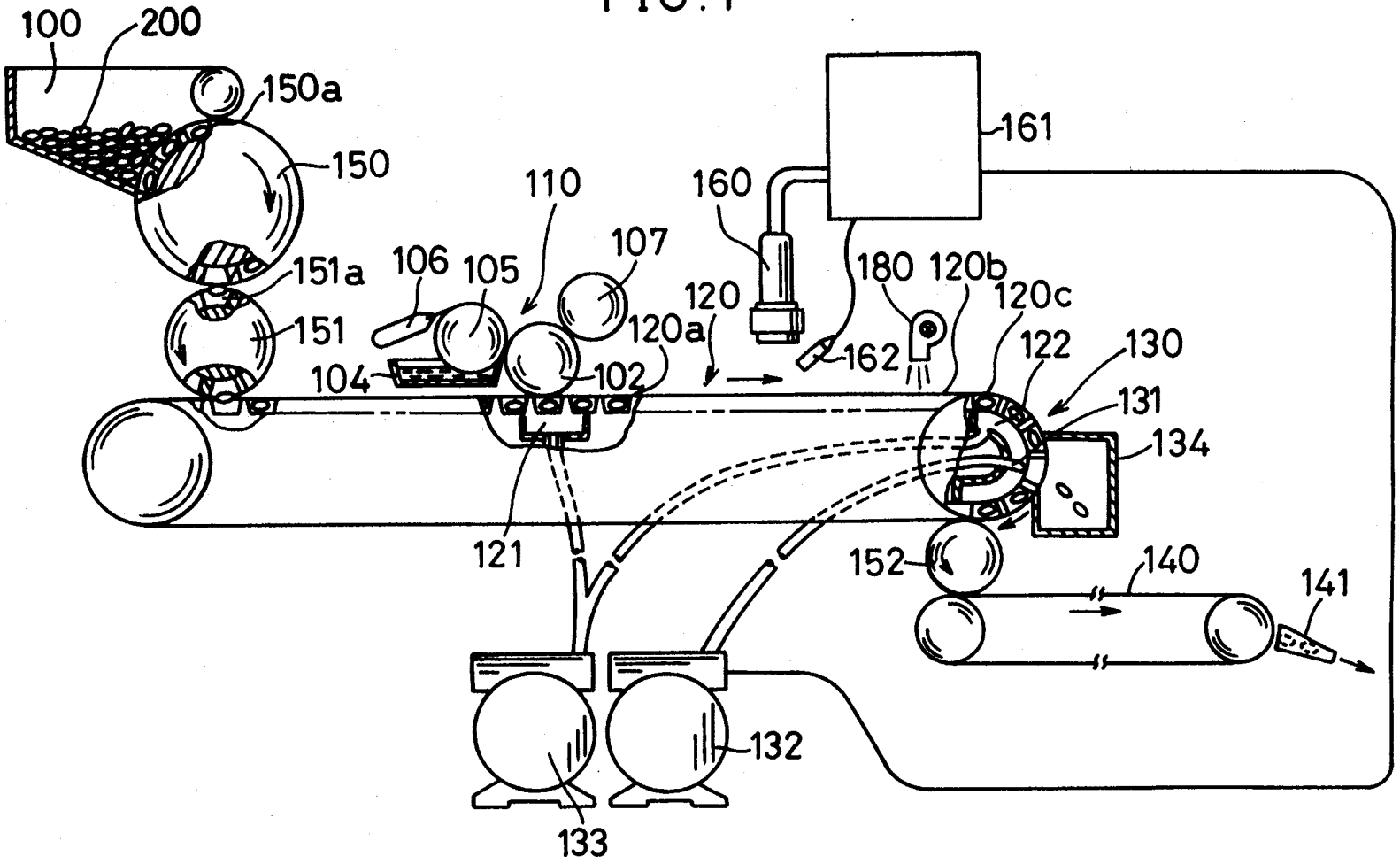
FIG. 1 is a partially sectional side view showing a first embodiment of a printer for solid articles in accordance with the invention.
Figure 4:
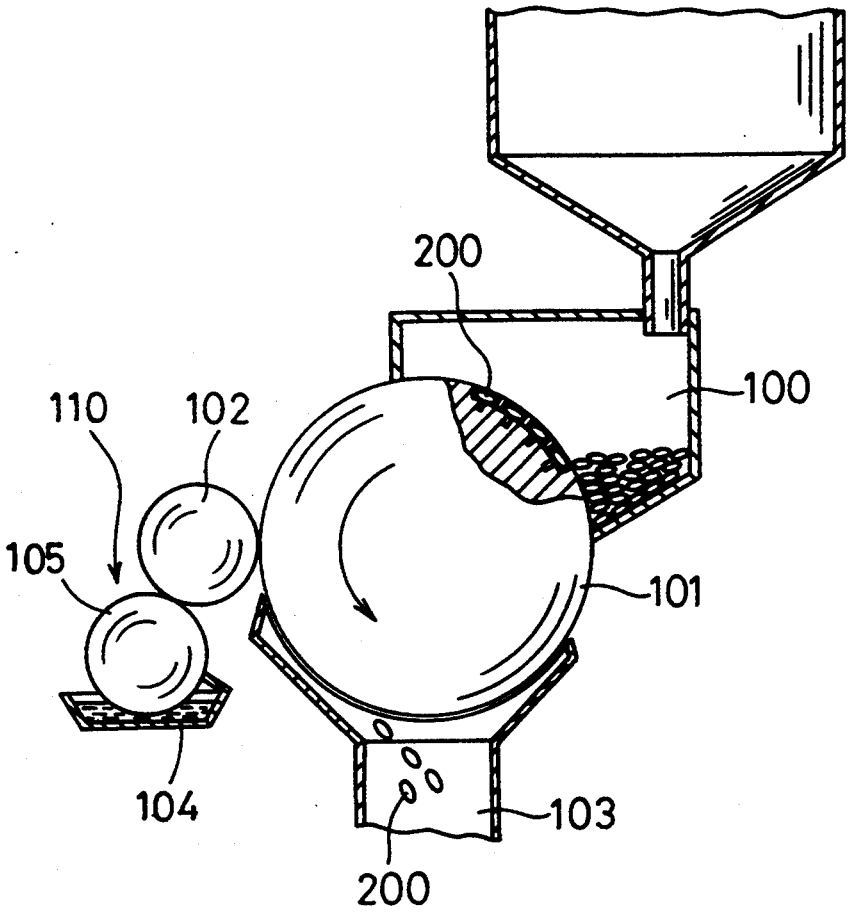
FIG. 4 (PRIOR ART)
FIG. 4 is a sectional side view showing a conventional printer for solid articles.

A first preferred embodiment of a printer for solid articles in accordance with the invention is described referring to FIG. 1. FIG. 1 is a partially sectional side view showing a first embodiment of the printer for solid articles. The elements designated by the same numerals in the conventional printer for solid articles shown in FIG. 4 have substantially the same functions.

As shown in FIG. 1, first and second drums 150 and 151 have a plurality of pockets 150*a* and 151*a* respectively arranged regularly on the drum surface in the rotational directions and axial directions. A small hole is provided in each pocket 150*a* or 151*a*. When the pockets 150*a* and 151*a* reach predetermined regions where the solid articles 200 should not drop by gravity, the air in the pockets 150 and 151 is drawn through the small holes so that the solid articles 200 are held in the pockets 150*a* and 151*a* by vacuum pressure. The solid articles 200 stored in the hopper 100 are positioned at a predetermined position in the pockets 150*a* of the first drum 150 by applying vibrations or air flow, as shown for example, in Publication Gazette of Examined Japanese Patent Application Sho 53- 32759. When each pocket 150*a* of the first drum 150 containing the solid article reaches to the lowest position where the first drum 150 faces the second drum 151, the absorption of the air is stopped, and the solid articles 200 drop to the pockets 151*a* of the second drum 151 by gravity. Similarly, when the pockets 151*a* of tile second drum 151 containing the solid articles 200 reach the lowest position, the absorption of the air is stopped. The first and second drums 150 and 151 are driven in order to synchronize the movement of the pocket 151*a* with the movement of the pocket 150*a*.

A conveyor 120 such as a chain conveyor, belt conveyor and the like is provided below the second drum 151. The conveyor 120 has a plurality of pockets 120*a* regularly arranged in the moving direction thereof and a direction perpendicular to the moving direction and facing the pockets 151*a* of the second drum 151. The conveyer 120 is driven, for example, lefthand to righthand in FIG. 1 for synchronizing the movement of the pocket 120*a* of the conveyor 120 with the movement of the pocket 151*a* of the second drum 151. A small hole (not shown in the figure) is provided in each pocket 120*a* for absorbing the air in the pocket 120*a*. In the vicinity of the left end of a horizontal carrier part 120*b* of the conveyor 120, the conveyor 120 faces the second drum 151, and the solid articles dropped from each pockets 151*a* of the second drum 151 are received and contained in the pockets 120*a* of the conveyor 120 which face the pockets 151*a*.

An ink pattern transfer device 110 is provided above substantially the center part of the horizontal carrier part 120*b*. The ink pattern transfer device 110 has an ink pan 104 for storing the ink, a design roller 105 having concave patterns on tile surface thereof corresponding to the patterns (letters, figures, marks, and the like), a cleaner 106 for wiping the superfluous ink from the surface of the design roller 105, a transfer roller 102 to which the ink remaining in the concave patterns of the design roller 105 is transferred, another cleaner 107 for cleaning the surface of the transfer roller 102, and so on. By pushing the ink patterns, which are just the reversal (turned inside out) patterns of the patterns to be printed and transferred to the surface of the transfer roller 102, to the surfaces of the solid articles 200, the solid articles 200 are printed. On the opposite side of the transfer roller 102 against the pocket 120*a*, that is the inside of the conveyor 120, an air absorption device 121 is provided. The air absorption device 121 is connected to a vacuum pump 133, and the air in the air absorption device 121 is absorbed. When the pockets 120*a* containing the solid articles passe the air absorption device 121, the air in the pockets 120*a* is drawn through the small holes (not shown in the figure because of the smallness), and the solid articles 200 are firmly held in the pockets 120*a*. As a result, the solid articles 200 may not move even when the transfer roller 102 rolls on the surfaces of the solid articles 200, and thus, the transference of the ink pattern (namely, the printing) is successfully completed.

Furthermore, an illuminator 162 and an image pick-up device 160 are provided at a position above the conveyor 120 and the righthand of the ink pattern transfer device 110 in FIG. 1. The image pick-up device 160 is connected to a print quality judging device 161. The print quality judging device 161 is configured by a microcomputer and so on, and it compares an image picked up by the image pick-up device 160 and predetermined patterns (which correspond to the minimum acceptable quality). When the print quality judging device 161 evaluates a solid article 200 as having inferior print quality, it outputs a removing signal after passing a predetermined time period which corresponds to the time necessary for tile solid article 200 of inferior print quality to reach an inferior article remover 130 which is described in detail below. Furthermore, an electric heater or hot-air dryer 180 is provided at the rear of the illuminator 162 for drying the ink transferred to the surfaces of tile solid articles 200.

The inferior article remover 130 has an air gun 131, an air compressor 132, an inferior article collecting basket 134, and so on, and is provided in the vicinity of a pulley part 120*c* of the conveyor 120 which rotates in the vertical plane. Another air absorption device 122 is provided in the pulley part 120*c* for preventing the solid articles 200 from dropping due to gravity when the pocket 120*a* containing the solid articles 200 passes this part 120*c*. On the other hand, when the pocket 120*a* containing the solid articles 200 of inferior print quality passes the inferior article remover 130, the air gun 131 and the air compressor 132 blast off the air of a predetermined pressure by receiving a removing signal from the print quality judging device 161, thereby tile solid article 200 of inferior print quality is blown off to the inferior article collection basket 134. As a result, the article of inferior print article is removed from the manufacturing process.

A third drum 152 which is substantially the same as the second drum 151 is provided below tile lowest part of the pulley part 120*c* of the conveyor 120. Furthermore, another conveyor 140, which is substantially the same as the conveyor 120, is provided below the lowest part of the third drum 152. While the solid articles 200 are carried by the conveyors 120 and 140, the ink transferred to the solid articles 200 is completely dried, and the printed solid articles 200 are collected in a collector 141.

Figure 2:
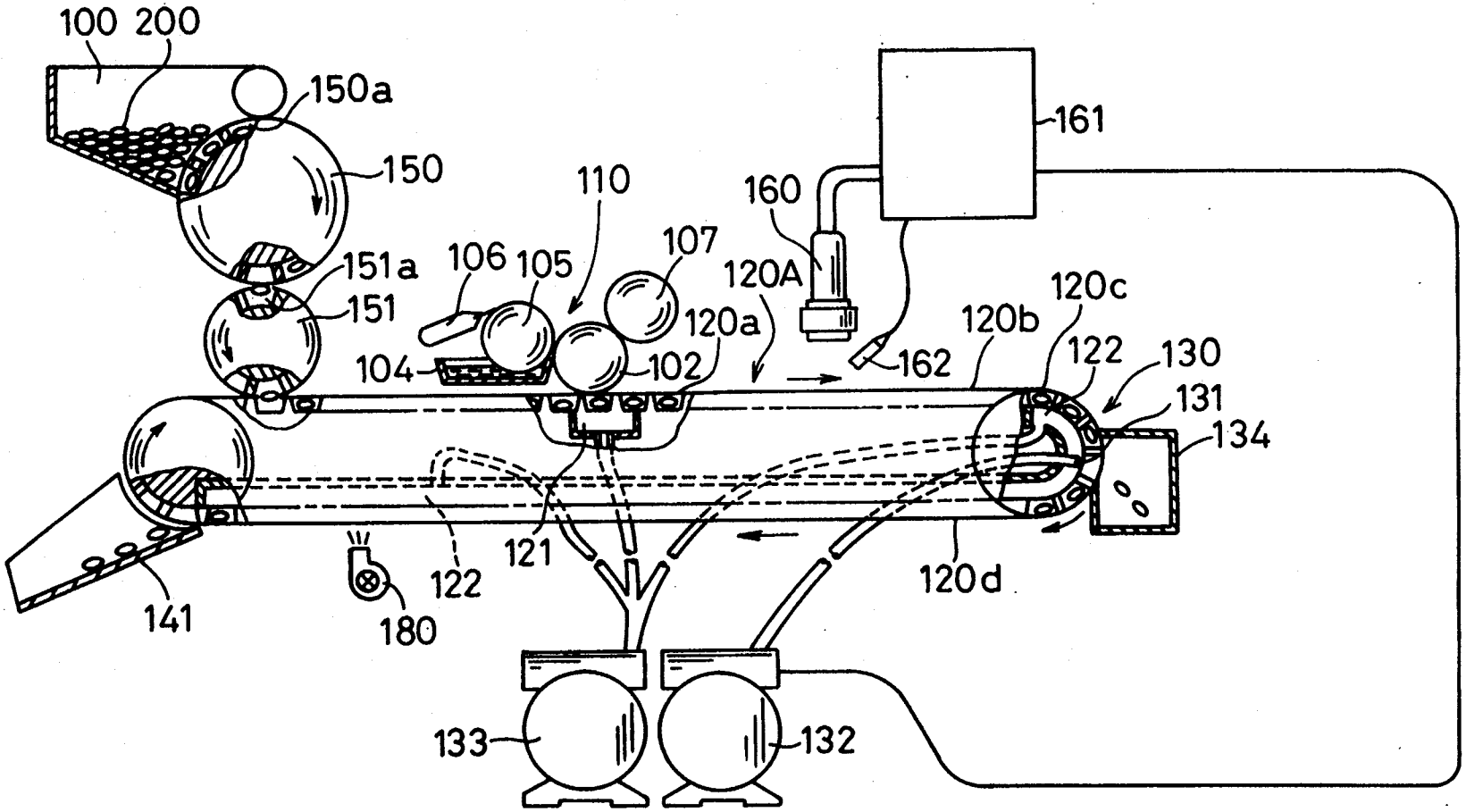
FIG. 2 is a partially sectional side view showing a second embodiment of a printer for solid articles in accordance with the invention.

A second preferred embodiment of a printer for solid articles in accordance with the invention is described by referring to FIG. 2. FIG. 2 is a partially sectional side view showing the second embodiment of the printer for solid articles. The elements designated by the same numerals in the above-mentioned first embodiment shown in FIG. 1 are substantially the same, and thus explanations of them are omitted.

As shown in FIG. 2, the reverse side 120*d* of the horizontal carrier part 120*b* of the conveyor 120 is used as a reverse horizontal carrier part. The air absorption device 122 is expanded to cover all of the reverse horizontal carrier part 120*d* so that the solid articles 200 do not drop due to gravity when the pockets 120*a* containing the solid articles 200 pass the reverse horizontal carrier part 120*d*. The collector 141 is provided at the end of the reverse horizontal carrier part 120*d*. In comparison with the first embodiment, the third drum 130 and the conveyor 140 can be omitted, and the breadth of the printer can be shortened. Furthermore, for accelerating the drying of the ink transferred to the solid articles 200, the electric heater or hot-air dryer 180 is provided below the reverse horizontal carrier part 120*d*. Owing to the operation of the dryer 180, the ink patterns transferred to the solid articles 200 are completely dried when the solid articles 200 are collected in the collector 141. Therefore, the ink patterns may not be spread evenly when the printed surfaces of the solid articles 200 contact the other solid articles or conveying faces of the conveyor.

Figure 3:
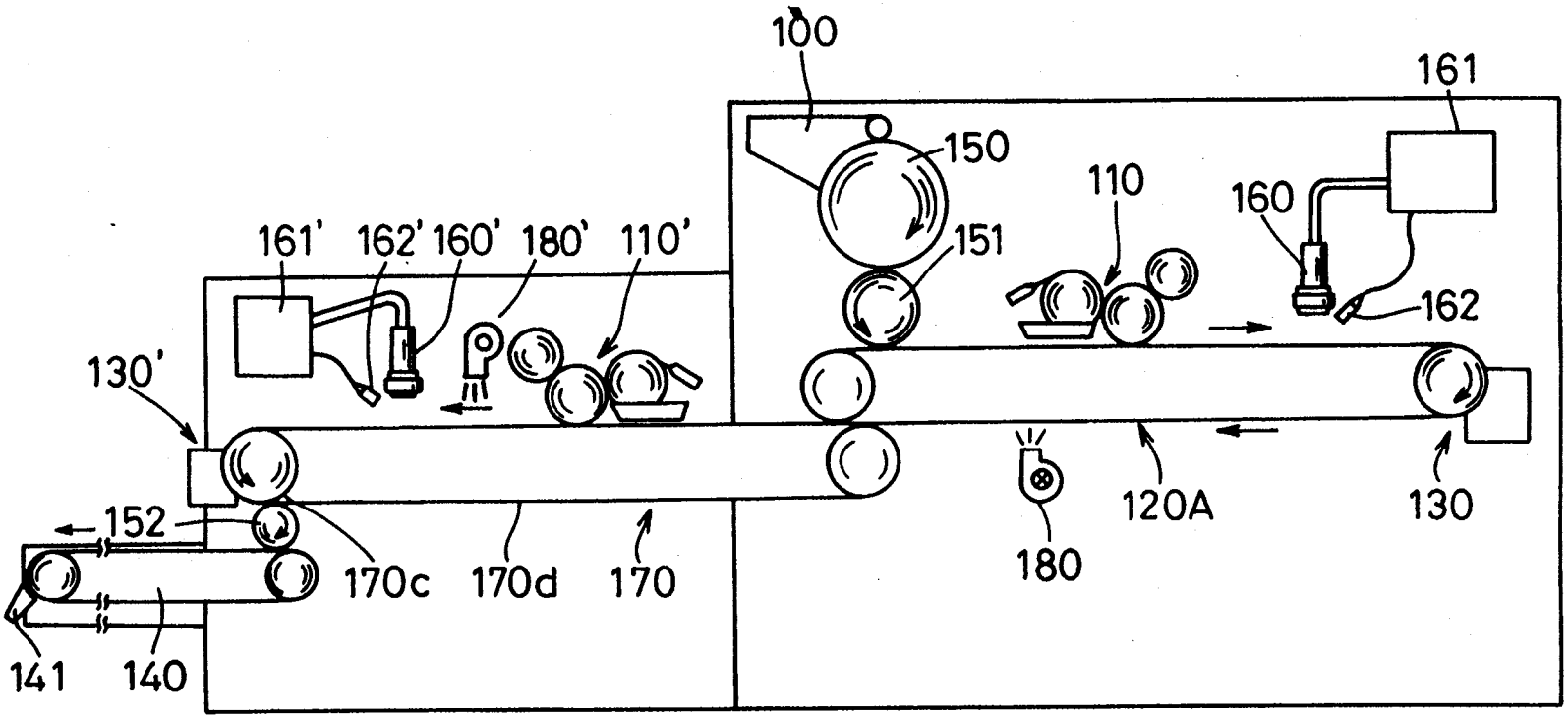
FIG. 3 is a partially sectional side view showing a third embodiment of a printer for solid articles in accordance with the invention.

A third preferred embodiment of a printer for solid articles in accordance with the invention is described by referring to FIG. 3. FIG. 3 is a partially sectional side view showing the third embodiment of the printer for solid articles. The elements designated by the same numerals in the afore-mentioned first embodiment shown in FIG.1 or in the second embodiment shown in FIG. 2 are substantially the same, and thus explanations of them are omitted.

In FIG. 3, the first conveyor 120A is substantially the same as the conveyor 120A in the above-mentioned second embodiment shown in FIG. 2. A second conveyor 170 is provided below the end part of the second (reverse) horizontal carrier part 120*d* of the first conveyor 120A in a manner such that the starting part of the second conveyor 170 faces the end part of the first conveyor 120A. The second conveyor 170 is substantially the same as the conveyor 120 in the first embodiment shown in FIG. 1, but the moving direction of tile second conveyor 170 is opposite the moving direction of tile conveyor 120. When the solid articles 200 carried by the first conveyor 120A are transferred to the second conveyor 170, the printed surfaces of the solid articles 200 are turned upside down. Namely, on the second conveyor 170, the printed surfaces of the solid articles become bottom faces, and the surfaces not printed yet become top faces.

A second ink pattern transfer device 110' is provided above the center part of the horizontal carrier part 170*a* of the second conveyor 170. Furthermore, at a position above the second conveyor 170 and the lefthand of the second ink pattern transfer device 110', a second illuminator 162', a second image pick-up device 160' and a second print quality judging device 161' are provided. A second inferior article remover 130' which is substantially the same as the inferior article remover 130 in the first embodiment shown in FIG. 1 is provided in a pulley part 170*c* of the second conveyor 170. Therefore, both sides of the solid articles 200 can be printed by the third embodiment.

The invention may be embodied in other specific forms without departing from the spirit and scope thereof. The embodiments are to be considered in all respects as illustrative and not restrictive. The scope of the invention is indicated by the appended claims rather than by the forgoing description, and all changes which come within the meaning and range of equivalency of the claims are intended to be embraced therein.

What is claimed is:

1. A printer for solid articles comprising:

a horizontal carrier which has regularly arranged pockets for holding and horizontally carrying solid articles in a predetermined carrying direction, each of said pockets having a through hole through which air flows;

a solid article feeder, which is disposed in the vicinity of an end of said horizontal carrier in an upstream part in said carrying direction, for feeding said solid articles to said horizontal carrier and arranging said solid articles regularly;

an ink pattern transfer device, which is disposed above a substantially center part of said horizontal carrier, to transfer previously designed ink patterns to surfaces of said solid articles which are carried by said horizontal carrier;

a print quality judging device, which is disposed above another part of said horizontal carrier downstream in said carrying direction from said ink pattern transfer device, to judge the quality of the transferred ink patterns on the surfaces of said solid articles so as to identify inferior articles; and an inferior article remover, which is disposed downstream of said print quality judging device in the vicinity of the other end of said horizontal carrier downstream in said carrying direction, for removing the inferior articles which are judged as inferior by said quality judging device.

2. The printer for solid articles in accordance with claim 1, further comprising:

a dryer, which is disposed downstream in said carrying direction from said ink pattern transfer device and above said horizontal carrier, for forcibly drying the transferred ink patterns on the surfaces of said solid articles.

3. The printer for solid articles in accordance with claim 1, wherein said inferior article remover has an air gun for blowing compressed air to an article of inferior print quality through said through hole of said pocket so as to remove said article of inferior print quality to an inferior article collector.

4. The printer for solid articles in accordance with claim 1, wherein said inferior article remover has an air gun for blowing compressed air to an article of inferior print quality through said through hole of said pocket so as to remove said article of inferior print quality to an inferior article collector; and having a dryer, which is disposed downstream in said carrying direction from said ink pattern transfer device and above said horizontal carrier, for forcibly drying the transferred ink patterns on the surfaces of said solid articles.

5. The printer for solid articles in accordance with claim 1, further comprising an air adsorption device, which is disposed in said horizontal carrier and below said ink pattern transfer device, for sucking air in said pockets through said through holes by vacuum pressure so that said solid articles in said pockets of said horizontal carrier are firmly held and do not move during printing by said ink pattern transfer device.

6. The printer for solid articles in accordance with claim 1, 2, 3, 4 or 5, wherein said horizontal carrier is an endless conveyor having rotating parts positioned at both horizontal ends thereof and rotating in the vertical plane, and using an upper horizontally moving part as said horizontal carrier; and further comprising:

an air adsorption device, which is disposed in one of said rotating parts positioned downstream in said carrying direction, for sucking air in said pockets through said through holes by vacuum pressure so that said solid article in said pockets in said rotating part are firmly held and do not drop out from said pockets due to gravity.

7. The printer for solid articles in accordance with claim 1, wherein a lower horizontally moving part of said conveyor serves as a reverse horizontal carrier for horizontally carrying the printed solid articles upside down in a reverse direction to said carrying direction; and further comprising:

an air adsorption device, which is disposed in said conveyor and along said reverse horizontal carrier, for sucking air in said pockets through said through holes by vacuum pressure so that said solid articles in said pockets of said reverse horizontal carrier are firmly held and do not drop out from said pockets due to gravity.

8. The printer for solid articles in accordance with claim 7, wherein said dryer is disposed below said reverse horizontal carrier for forcibly drying the transferred ink patterns on the surfaces of said solid articles.

9. A printer for solid articles comprising:

a first horizontal carrier which has regularly arranged pockets for holding and horizontally carrying solid articles in a predetermined first carrying direction, each of said pockets having a through hole through which air flows;

a solid article feeder, which is disposed in the vicinity of an end of said first horizontal carrier and upstream in said carrying direction, for feeding said solid articles to said horizontal carrier and arranging said solid articles regularly;

a first ink pattern transfer device, which is disposed above a substantially center part of said first horizontal carrier, to transfer previously designed first ink patterns to the surfaces of said solid articles which are carried by said first horizontal carrier;

a first print quality judging device, which is disposed above another part of said first horizontal carrier and downstream in said first carrying direction from said first ink pattern transfer device, to judge the quality of the transferred first ink patterns on the surfaces of said solid articles so as to identify inferior articles;

a first inferior article remover, which is disposed in the vicinity of the other end of said first horizontal carrier downstream in said first carrying direction, for removing the inferior articles which are judged as inferior by said first quality judging device;

a second horizontal carrier which has regularly arranged pockets for holding and horizontally carrying upside down said solid articles passing through said first inferior article remover in a predetermined second carrying direction, each of said pockets having a through hole through which air flows;

a second ink pattern transfer device, which is disposed above a substantially center part of said second horizontal carrier, to transfer previously designed second ink patterns to the surfaces of said solid articles which are not printed yet and which are carried by said second horizontal carrier;

a second print quality judging device, which is disposed above another part of said second horizontal carrier downstream in said second carrying direction from said second ink pattern transfer device, to judge the quality of the transferred second ink patterns transferred to said solid articles so as to identify inferior articles; and a second inferior article remover, which is disposed in the vicinity of the other end of said second horizontal carrier downstream in said second carrying direction, for removing the inferior articles which are judged as inferior by said second quality judging device.

10. The printer for solid articles in accordance with claim 9, further comprising:

a first dryer, which is disposed downstream in said first carrying direction to said first ink pattern transfer device and above said first horizontal carrier, for forcibly drying the transferred first ink patterns on the surfaces of said solid articles.

11. The printer for solid articles in accordance with claim 10, further comprising:

a second dryer, which is disposed downstream in said second carrying direction from said second ink pattern transfer device and above said second horizontal carrier, for forcibly drying the transferred second ink pattern on the surfaces of said solid articles.

12. The printer for solid articles in accordance with claim 9, wherein said first and second inferior article removers have an air gun for blowing compressed air to the article of inferior print quality through said through hole of said pocket so as to remove said article of inferior print quality to an inferior article collector.

13. The printer for solid articles in accordance with claim 9, further comprising air adsorption devices, which are respectively disposed below said first and second ink pattern transfer devices in said first and second horizontal carriers, for sucking air in said pockets through said through holes by vacuum pressure so that said solid articles in said pockets of said first and second horizontal carriers are firmly held and do not move during printing by said ink pattern transfer device.

14. The printer for solid articles in accordance with claim 9, 10, 11, 12 or 13, wherein said first and second horizontal carriers are endless conveyors respectively having rotating parts positioned at both horizontal ends thereof and rotating in the vertical plane, and using upper horizontally moving parts as said first and second horizontal carriers; and further comprising:

air adsorption devices, which are respectively disposed in one of said rotating parts positioned in said first and second carrying directions, for sucking air in said pockets through said through holes by vacuum pressure so that said solid article in said pockets in said rotating part are firmly held and do not drop out from said pockets due to gravity.

15. A printer for solid articles in accordance with claim 14, further comprising:

a solid articles reversing device provided between said first horizontal carrier and said second horizontal carrier for turning the solid articles upside down.

16. A printer for solid articles in accordance with claim 15, wherein said solid articles reversing device is a reverse horizontal carrier provided at the reverse side of said horizontal carrier for horizontally carrying the printed solid articles upside down in a reverse direction.

17. A printer for solid articles comprising:

a horizontal carrier of an endless conveyor, which has regularly arranged pockets for holding and horizontally carrying solid articles in a predetermined carrying direction, each of said pockets having a through hole through which air flows, and having rotating parts positioned at both horizontal ends of said conveyor and rotating in the vertical plane, and using an upper horizontally moving part as said horizontal carrier;

a solid article feeder, which is disposed in the vicinity of an end of said horizontal carrier upstream in said carrying direction, for feeding said solid articles to said horizontal carrier and arranging said solid articles regularly;

an ink pattern transfer device, which is disposed above a substantially center part of said horizontal carrier, to transfer previously designed ink patterns to the surfaces of said solid articles which are carried by said horizontal carrier;

a print quality judging device, which is disposed above another part of said horizontal carrier downstream in said carrying direction from said ink pattern transfer device, to judge the quality of the transferred ink patterns on the surfaces of said solid articles so as to identify inferior articles;

an inferior article remover having an air gun, which is disposed in one of said rotating parts positioned downstream in said carrying direction, for removing the inferior article which is judged as inferior by said quality judging device by blowing compressed air to said article of inferior print quality through said through hole of said pocket so as to remove said article of inferior print quality to an inferior article collector;

a dryer, which is disposed downstream in said carrying direction from said ink pattern transfer device and above said horizontal carrier, for forcibly drying the transferred ink patterns on the surfaces of said solid articles; and an air adsorption device, which is disposed in one of said rotating parts positioned downstream in said carrying direction, for sucking air in said pockets through said through holes by vacuum pressure so that said solid article in said pockets in said rotating part are firmly held and do not drop out from said pockets due to gravity.

18. The printer for solid articles in accordance with claim 17, wherein a lower horizontally moving part of said horizontal conveyor serves as a reverse horizontal carrier for horizontally carrying the printed solid articles upside down in a reverse direction to said horizontal carrying direction; and further comprising:

an air adsorption device, which is disposed in said horizontal conveyor and along said reverse horizontal carrier, for sucking air in said pockets through said through holes by vacuum pressure so that said solid articles in said pockets of said reverse horizontal carrier are firmly held and do not drop out from said pockets due to gravity.

19. The printer for solid articles in accordance with claim 18, wherein said dryer is disposed below said reverse horizontal carrier for forcibly drying the transferred ink patterns on the surfaces of said solid articles.

* * * * *